US007748305B2

(12) United States Patent
Strenio et al.

(10) Patent No.: US 7,748,305 B2
(45) Date of Patent: Jul. 6, 2010

(54) EGG SLICING APPARATUS

(76) Inventors: Paul David Strenio, 115 Pamela St., China Grove, NC (US) 28023; Carol Anne Strenio, 115 Pamela St., China Grove, NC (US) 28023

( * ) Notice: Subject to any disclaimer, the term of this patent is extended or adjusted under 35 U.S.C. 154(b) by 914 days.

(21) Appl. No.: 11/244,748

(22) Filed: Oct. 5, 2005

(65) Prior Publication Data

US 2006/0073257 A1 Apr. 6, 2006

Related U.S. Application Data

(60) Provisional application No. 60/616,327, filed on Oct. 6, 2004.

(51) Int. Cl.
*B26D 3/00* (2006.01)

(52) U.S. Cl. ..... 83/861; 83/932

(58) Field of Classification Search ..... 99/497, 99/537–538; 83/861, 870, 932, 694, 697, 83/563, 613, 451, 466.1, 13; 30/117, 279.2, 30/299, 314, 315; D7/674; 426/518, 644, 426/478

See application file for complete search history.

(56) References Cited

U.S. PATENT DOCUMENTS

| | | | | |
|---|---|---|---|---|
| 1,772,020 | A * | 8/1930 | Taylor | 99/515 |
| 4,095,339 | A | 6/1978 | Turner | |
| 4,383,365 | A | 5/1983 | Metzigian | |
| 4,625,607 | A | 12/1986 | Maillez | |
| 4,656,928 | A | 4/1987 | Mack | |
| D297,798 | S | 9/1988 | Leung | |
| 4,790,740 | A | 12/1988 | Pearlman | |
| 4,934,053 | A * | 6/1990 | Johnson | 30/135 |
| 4,937,938 | A | 7/1990 | Koo | |
| D318,601 | S | 7/1991 | Barnett | |
| 5,431,078 | A * | 7/1995 | Ricard et al. | 83/870 |
| 5,749,145 | A | 5/1998 | Baukloh | |
| D400,065 | S | 10/1998 | Fohrman | |
| D421,369 | S | 3/2000 | Samarasinghe | |
| 6,049,984 | A * | 4/2000 | McGehee | 30/113 |
| D436,504 | S | 1/2001 | Demers | |
| 6,318,222 | B1 | 11/2001 | Weinman, Jr. | |
| D464,851 | S | 10/2002 | Dorion | |

FOREIGN PATENT DOCUMENTS

| | | | |
|---|---|---|---|
| GB | 2201333 | A * | 9/1988 |
| GB | 2201333 | A * | 9/1988 |

* cited by examiner

*Primary Examiner*—Keith D Hendricks
*Assistant Examiner*—Jenna A Watts
(74) *Attorney, Agent, or Firm*—Clements Bernard PLLC; Russell M. Racine

(57) ABSTRACT

The present invention is a handheld apparatus which slices the white portion of a boiled egg in a manner allowing the egg to then be processed into and used as a deviled egg. Specifically, the apparatus slices the egg white by mating two cutting edges, each having a mating concave portion, slidably engaged to move in a vertical direction toward each other thereby slicing the egg white lengthwise into two equal halves while the egg yolk remains stationary in the concave portion and is not sliced.

7 Claims, 2 Drawing Sheets

FIG. 1
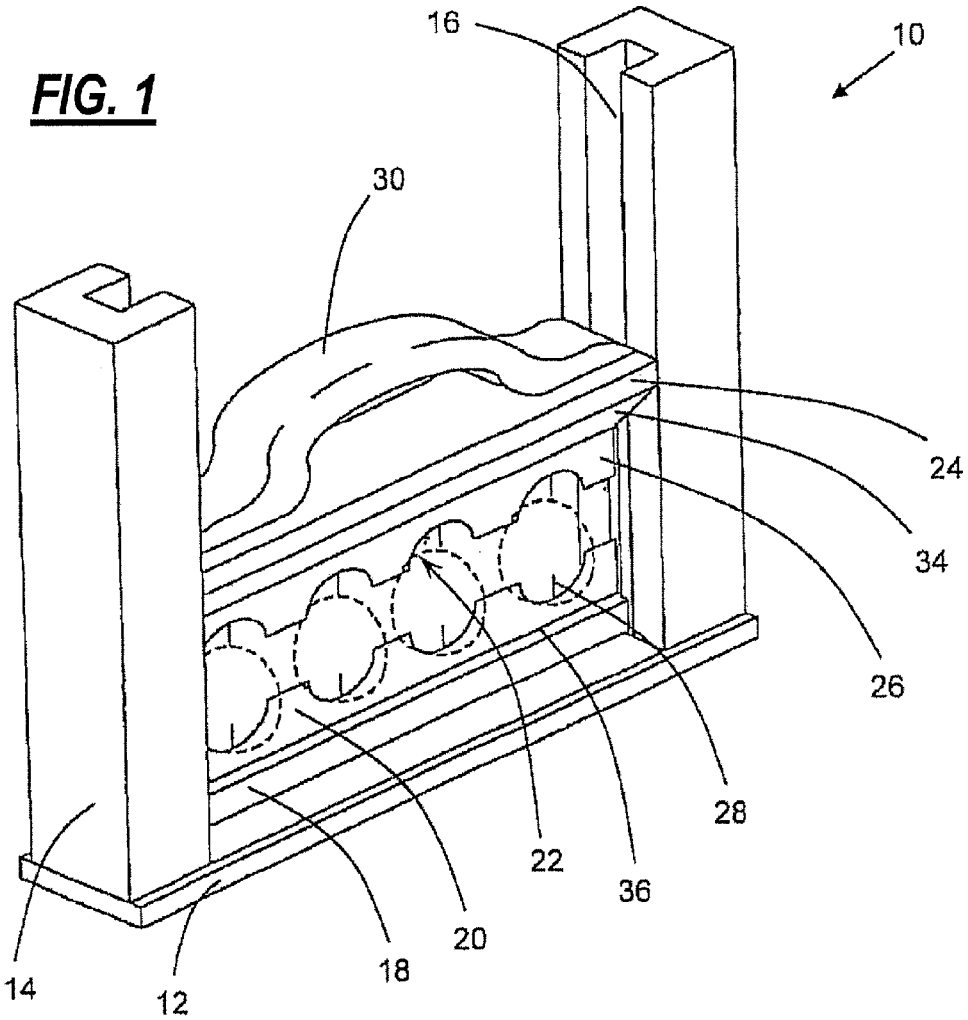
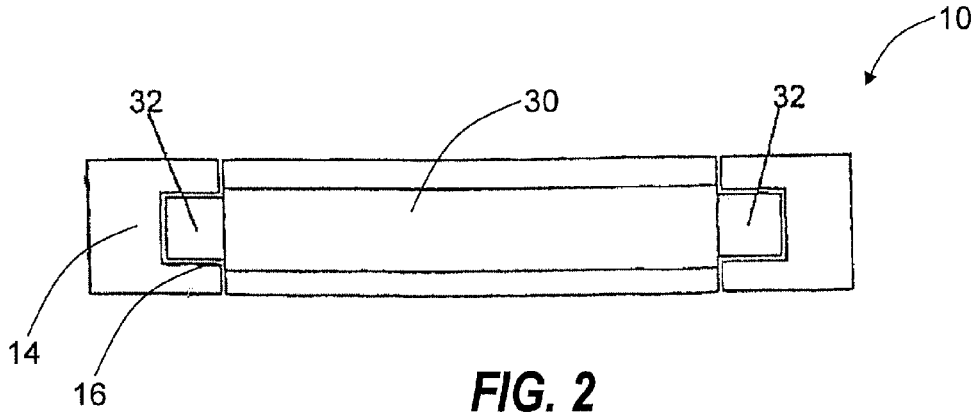
FIG. 2

EGG SLICING APPARATUS

CROSS REFERENCE TO RELATED APPLICATION

This application claims the benefit of the earlier filing date of my currently pending Provisional U.S. Patent Application Ser. No. 60/616,327, filed Oct. 6, 2004.

FIELD OF THE INVENTION

The present invention relates to an apparatus for slicing boiled eggs along their lengths while keeping the yolk fully intact and the separated egg whites intact in two equal halves for processing into deviled eggs.

BACKGROUND OF THE INVENTION

Restaurants, caterers, and hosts of parties often serve deviled eggs as part of a meal, or as hors d'oeuvres or an appetizer. Deviled eggs are usually made by a multi-step process. Typically, a chef creates a deviled egg by first boiling a raw egg until it becomes hard-boiled, i.e., solidifies into an egg white portion surrounding an egg yolk portion. After boiling and subsequent cooling, a chef begins to process the hard-boiled egg into the deviled egg by peeling the shell away from the egg white thereby exposing it for processing. After shelling the egg, the chef continues by slicing the egg lengthwise into two equal sized halves. Once the egg is sliced the chef has access to the inner yolk which is what is actually processed into the filling that characterizes a deviled egg. The chef continues by removing each half of the egg yolk and begins processing the yolk to create the characteristic deviling. This deviling is done by blending the egg yolk with spices, mayonnaise, relish, peppers or any other food item the chef decides to include in his deviled egg mixture. Finally, the chef finishes the deviled egg by placing the yolk mixture into the empty egg white halves from which the yolk was previously removed. As can be readily ascertained, this process takes considerable time and is need of improvement.

This need is even greater in the food for profit industry such as restaurants, catering businesses, or any enterprise that serves food to multiple people. In the restaurant and catering industries, a need exists to find the ability and means to create large numbers of deviled eggs quickly and efficiently to minimize the time expenditure and maximize the number of people served. Currently the method used to prepare large numbers of deviled eggs as discussed above is too slow and inefficient. Therefore there is a need for an improved method of preparing deviled eggs. More specifically, a need exists for a method of preparing multiple deviled eggs at the same time in order to speed up the process. A need also exists for an apparatus that allows a person to simultaneously prepare multiple boiled eggs for deviling that can be used and reused repeatedly.

A desirable type of apparatus for use by chefs and food preparation personnel should be small enough to hold in one hand and yet process multiple boiled eggs at the same time. In addition, the apparatus should be able to slice the eggs in such a manner that the egg whites are separated from the egg yolk. Also, the apparatus should preserve the shape of the egg white for later filling by the processed egg yolk. Finally, the apparatus should be capable of immediate reuse and should be easy to clean and disinfect.

Currently available egg slicing devices do not meet the present need. Devices that are currently available do not perform the functions needed to mass produce deviled eggs in a time efficient manner. Specifically, presently known devices do not cut an egg into two halves for making deviled eggs. Currently, typical egg slicers use thin wire to cut a hard-boiled egg into multiple round slices or multiple wedge shaped slices. Obviously, this shape cannot be used to create a deviled egg, as the egg white needs to be preserved intact in two substantially equal pieces. Also, the egg slicing devices currently available do not separate the egg white from the yolk. To create a deviled egg, the egg yolk must be processed separately from the egg white. Finally, the current devices for egg slicing and processing do not cut the egg leaving the yolk intact. The yolk is cut along with the egg white making it difficult to separate the yolk from the white. Therefore it can be readily seen that there exists a need within the art for an apparatus that achieves the goals of the present invention.

DESCRIPTION OF THE PRIOR ART

Applicant is aware of the following U.S. Patents and applications concerning egg slicing devices and the like:

Turner U.S. Pat. No. 4,095,339, dated Jun. 20, 1978, entitled Egg Slicer, teaches an egg slicer which is handheld but only holds one egg and slices in multiple round discs of uniform thickness.

Metzigian U.S. Pat. No. 4,383,365, dated May 17, 1983, entitled Egg Slicer With Interchangeable Components, discloses a slicer for use with foods that slices the food into multiple pieces depending on the format and shape of the cutter. The cutter is mounted in the handle and pressed down through the food.

Maillez U.S. Pat. No. 4,625,607, dated Dec. 2, 1986, teaches a food slicer adaptable for various foods but only slices one egg at a time. The cutter is affixed on the handle and cuts the food as the handle is depressed.

Mack U.S. Pat. No. 4,656,928, dated Apr. 14, 1987, entitled Apparatus For Molding and Cooking Multiple Egg Products, teaches a device that allows the preparation of a substitute yolk and the formation of cooked egg white around the substitute yolk. This device does not slice the egg product once it is formed.

Pearlman U.S. Pat. No. 4,790,740, dated Dec. 13, 1998, entitled Apparatus for Preparing a Decorative Cooked Egg, teaches a mold for eggs that is used to give a precooked egg a decorative appearance. It does not contain a cutter.

Koo U.S. Pat. No. 4,937,938, dated Jul. 3, 1990, entitled Egg Slicers, uses wires as cutting means to slice a single egg into slices of equal thickness. It holds one egg only and can be operated with one hand.

Baukloh U.S. Pat. No. 5,749,145, dated May 12, 1998, entitled Egg Cutter, uses wires to cut through a cooked egg and slice it into disks or wedges depending on the selection of wire cutters. The device can be operated with one hand, but it does not allow for cutting multiple eggs at one time.

Weinman, Jr. U.S. Pat. No. 6,318,222, dated Nov. 20, 2001, entitled Apparatus and Method For Uniform Even Slicing teaches a method and apparatus to slice foods where a blade is suspended above a cutting surface at a fixed distance. The blade is then used against the surface and food to cut a uniform slice. This does not allow for the cutting of multiple eggs.

Applicant is aware of the following design patents relating to egg slicing devices and the like:

Leung U.S. Pat. No. D297,798, dated Sep. 27, 1998, entitled Wire-Type Slicer.

Fohrman U.S. Pat. No. D400,065, dated Oct. 27, 1998, entitled Egg Slicer.

Barnett U.S. Pat. No. D318,601, dated Jul. 30, 1991, entitled Egg Slicer.

Samarasinghe U.S. Pat. No. D421,369, dated Mar. 7, 2000, entitled Egg Slicer.

Demers U.S. Pat. No. D436,504, dated Jan. 23, 2001, entitled Egg Slicer.

Dorion U.S. Pat. No. D464,851, dated Oct. 29, 2002, entitled Egg Slicer.

SUMMARY OF THE INVENTION

The present invention provides a handheld apparatus which slices boiled eggs in a manner allowing the egg to then be processed into and used as a deviled egg. Specifically, the apparatus slices the egg white lengthwise into two equal halves while the egg yolk remains stationary and is not sliced. The apparatus can slice multiple eggs at the same time. The apparatus automatically separates the intact egg yolk from the two egg white halves by removing the egg whites.

OBJECTS OF THE INVENTION

The principal object of the present invention is to provide an apparatus for slicing eggs lengthwise for use as deviled eggs.

Another object of the invention is to slice multiple eggs at the same time.

A further object of this invention is to preserve an egg yolk intact while separating the yolk from sliced egg whites.

It is a further object of the present invention to provide an apparatus for slicing the white portion of boiled eggs. The apparatus generally comprises a base affixed to vertical supports. The vertical supports are connected to the base at the ends of the base and have a recess defining a vertical passageway within the vertical supports. The apparatus also has a lower wedge shaped member connected to the base and extending from said first vertical support to said second vertical support. The lower wedge is holding a bottom blade pointing substantially upwards so that the lower wedge forms a cutting edge pointing upwardly. The cutting edge has at least one concave section adapted to receive a hard-boiled egg along the edge of the cutting edge. Also, the apparatus has an upper wedge shaped member that is engaged with the vertical passageways and extends between the vertical supports. The upper wedge member is shaped so that the ends of the wedge member extend into the passageways in the vertical supports. The wedge member is vertically movable within the passageways and, the upper wedge member is holding an upper blade pointing downwardly and having a lower cutting edge. The cutting edge has at least one concave section adapted to receive an egg so that when the upper wedge member is lowered toward the lower wedge member the concave sections mate to form an egg-yolk shaped open portion.

BRIEF DESCRIPTION OF THE DRAWINGS

The foregoing and other objects will become more readily apparent by referring to the following detailed description and the appended drawings in which:

FIG. 1 is a perspective view of the Egg Slicing Apparatus in accordance with the invention.

FIG. 2 is a top view of the Egg Slicing Apparatus in accordance with the invention.

DETAILED DESCRIPTION

Figure 3:
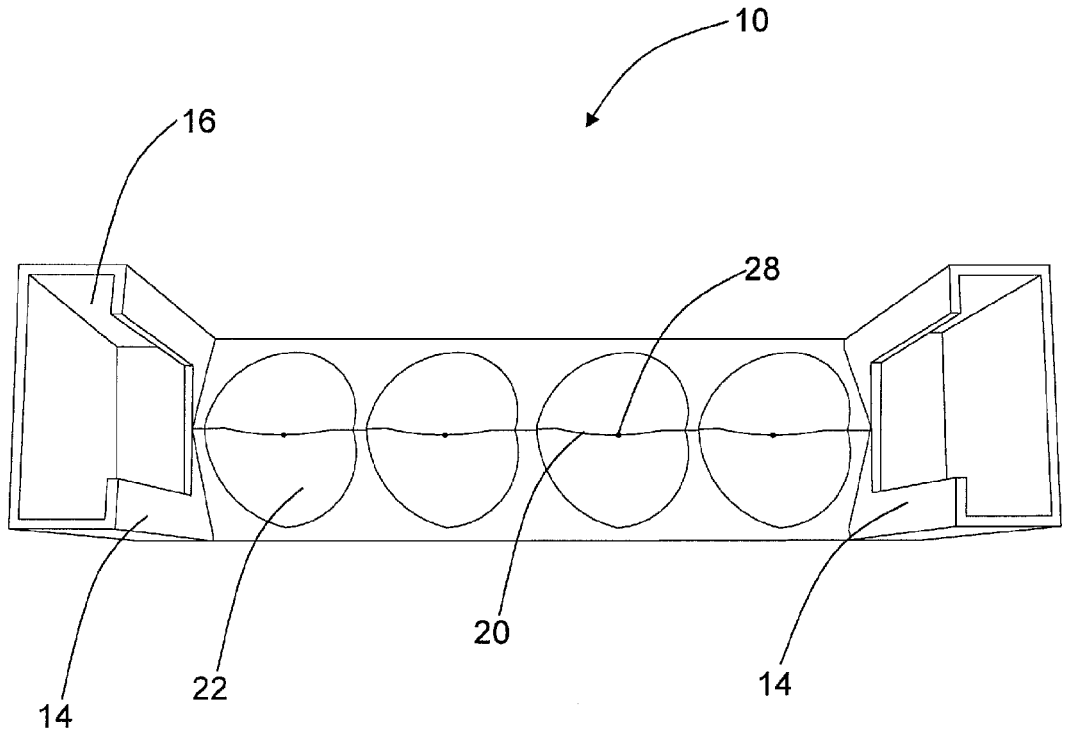
FIG. 3 is a top view of the Egg Slicing Apparatus in accordance with the invention.

Referring now to the drawings, and particularly to FIG. 1, the invented apparatus (10) includes a base (12) connecting and supporting two upright posts (14). The two posts (14) each are provided with an open area (16) enclosed on three sides running up the length of the posts (14) and defining a movement guiding track (16). A base blade holder (18) is attached to the base (12) located in the middle between the two upright posts (14). The base blade holder (18) holds a bottom blade (20) in an upright vertical position with an upper cutting edge. The bottom blade (20) spans the entire length of the base (12) between the movement guiding tracks (16). Spaced along the bottom blade (20) are concave indentations (22) approximately the size of an egg.

A movable top member (24) is located above the bottom blade (20) and spans the entire length between the upright posts (14). Attached to the underside of the movable top member (24) is the top blade (26) having a lower cutting edge. The top blade (26) spans the entire length of the top member (24) and is a mirror image of the bottom blade (20) such that when the top blade (26) is lowered onto the bottom blade (20) the concave portions form an open egg shape. Affixed to the top of the movable top member (24) is a handle (30) used to raise and lower the movable top member (24). The ends of the movable top member have two protrusions (32) that extend into the movement guiding track (16) keeping the movable top blade (26) aligned with the bottom blade (20).

A pin (28) is advantageously mounted in each recess (22) of the bottom blade to retain the yolk after the egg white is cut and falls away.

In operation, the bottom blade (20) supports a boiled egg in an upright vertical position. The handle (30) lowers toward the egg sliding along the guiding track (16). As the handle (30) gets closer to the bottom blade (20), the upper blade (26) begins to pierce and cut the egg. The handle (30) continues to lower and the upper blade (26) comes into contact with the lower blade (20). The upper blade (26) and the lower blade (20) slice the egg symmetrically lengthwise as the two blades meet. As the egg is sliced, the egg whites come away from the upper blade (26) and the lower blade (20) exposing the intact egg yolk. The egg yolk is supported and held in place by the pin (28).

SUMMARY OF THE ACHIEVEMENT OF THE OBJECTS OF THE INVENTION

From the foregoing, it is readily apparent that we have invented an improved egg slicer apparatus for use in preparing decorative or deviled eggs. The apparatus can be used in one hand and can slice multiple eggs at the same time. As the handle is depressed, the eggs are sliced, the yolk is preserved intact, and the egg whites are separated from the yolks and released from the apparatus. This invented apparatus provides a far superior way for restaurants, caterers and food preparers to prepare deviled eggs. Multiple eggs can be prepared at once thereby decreasing the time it takes to prepare deviled eggs. This increases a restaurant's productivity and therefore profitability.

It is to be understood that the foregoing description and specific embodiments are merely illustrative of the best mode of the invention and the principles thereof, and that various modifications and additions may be made to the apparatus by those skilled in the art, without departing from the spirit and scope of this invention.

We claim:

1. An apparatus for slicing the white portion of boiled eggs comprising:

a base;

a first vertical support connected to said base at one end of said base and having a recess defining a vertical passageway within said first vertical support;

a second vertical support connected to said base in opposed relation to said first vertical support, said second vertical support having a recess defining a vertical passageway within said second vertical support, that said passageways being open to each other;

a lower wedge shaped member connected to said base and extending from said first vertical support to said second vertical support, said lower wedge holding a bottom blade pointing substantially upwards so that said lower wedge forms a cutting edge pointing upwardly, said cutting edge having at least one concave section adapted to receive a hard-boiled egg along the edge of said cutting edge;

an upper wedge shaped member slidably engaged with said vertical passageways and extending between said first vertical support and said second vertical support, said upper wedge member shaped so that the ends of said upper wedge member extend into said passageways in said first and second vertical supports, said upper wedge member being vertically movable within said passageways, said upper wedge member holding an upper blade pointing downwardly and having a lower cutting edge, said cutting edge having at least one concave section adapted to receive an egg so that when said upper wedge member is lowered toward said lower wedge member said concave sections mate to form an egg-yolk shaped open portion.

2. An apparatus for slicing boiled eggs according to claim 1 further comprising a handle connected to the top of said upper wedge for moving said upper wedge vertically within said passageways.

3. An apparatus for slicing boiled eggs according to claim 1 having a thin vertical post fixed to and protruding upwardly from said lower concave section.

4. An apparatus for slicing boiled eggs according to claim 1 having a plurality of mating upper and lower concave sections in horizontally spaced relation.

5. An apparatus according to claim 1 wherein said vertical passageway has a V-shaped cross-section.

6. An apparatus according to claim 1 wherein said vertical passageway has a C-shaped cross-section.

7. An apparatus for slicing boiled eggs according to claim 3 wherein said vertical post is metal or plastic.

* * * * *